US007768473B2

(12) United States Patent
Kardohely

(10) Patent No.: US 7,768,473 B2
(45) Date of Patent: Aug. 3, 2010

(54) STRAP DRIVEN FIELD MAST

(75) Inventor: Michael James Kardohely, West Salem, OH (US)

(73) Assignee: The Will-Burt Company, Orville, OH (US)

( * ) Notice: Subject to any disclaimer, the term of this patent is extended or adjusted under 35 U.S.C. 154(b) by 320 days.

(21) Appl. No.: 11/977,257

(22) Filed: Oct. 24, 2007

(65) Prior Publication Data

US 2009/0110527 A1 Apr. 30, 2009

(51) Int. Cl.
*H01Q 1/10* (2006.01)

(52) U.S. Cl. ..... 343/883; 343/880

(58) Field of Classification Search ..... 343/878, 343/880, 883, 889, 901; 52/110, 118, 121; 74/89.23, 89.28, 89.39, 89.45
See application file for complete search history.

(56) References Cited

U.S. PATENT DOCUMENTS

| | | | | |
|---|---|---|---|---|
| 4,785,309 | A | 11/1988 | Gremillion | |
| 4,932,176 | A | 6/1990 | Roberts et al. | |
| 5,101,215 | A | 3/1992 | Creaser, Jr. | |
| 5,218,375 | A | 6/1993 | Hillman | |
| 5,233,809 | A | 8/1993 | Gropper | |
| 5,537,125 | A * | 7/1996 | Harrell et al. | 343/878 |
| 5,871,069 | A | 2/1999 | Carmitchel | |
| 6,046,706 | A | 4/2000 | Vargas | |
| 7,574,832 | B1 * | 8/2009 | Lieberman | 52/118 |
| 2002/0145029 | A1 | 10/2002 | Konen et al. | |
| 2003/0161622 | A1 * | 8/2003 | Zantos | 396/419 |
| 2006/0213295 | A1 | 9/2006 | Blackwelder et al. | |

OTHER PUBLICATIONS

International Search Report (PCT US2008/061112), dated Aug. 14, 2008.
http://www.mastsystem.com/products.html, Mastsystem Products, Jul. 16, 2007, 4 pages.

* cited by examiner

*Primary Examiner*—Hoang V Nguyen
(74) *Attorney, Agent, or Firm*—Fay Sharpe LLP

(57) ABSTRACT

A portable telescopic mast assembly with positive retraction for raising and lowering an associated device includes an outer body and a plurality of mast sections slideably engaged with the outer body. A lifting cable is disposed between the plurality of mast sections. The lifting cable operatively connects the plurality of mast sections so as to urge one or more of the mast sections towards an extended position. The lifting cable includes a first end and a second end, the first end being secured to an inner most mast section of the plurality of mast sections. A retraction cable is disposed at least partially inside the outer body. The retraction cable includes a first end and a second end, the first end being secured to the inner most mast section. A winch is secured to the outer body. The winch includes a first output and a second output, the second end of the lifting cable operatively connected to the first output and the second end of the retraction cable operatively connected to the second output.

23 Claims, 14 Drawing Sheets

STRAP DRIVEN FIELD MAST

BACKGROUND

The present exemplary embodiment relates to extendable masts. It finds particular application in conjunction with portable masts that are intended to be rapidly deployed and or removed while in the field, and will be described with particular reference thereto. However, it is to be appreciated that the present exemplary embodiment is also amenable to other like applications.

Various field mast designs are known in the art. Generally, a field mast is a transportable rapidly deployable support column having a height adjust system for raising or lowering an associated device. The associated device can include a communication, audio/video, and or lighting system or any other device whose function or performance is dependent on height or line of sight operation. Typical applications of such masts include both military and civilian settings where a mast must be erected quickly, quietly and or manually.

However, the prior art field mast assemblies are deficient in a number of ways. First, it is a typical and recurring problem that in the process of removing or collapsing the prior art field masts, the individual mast sections will bind and prevent the mast assembly from being placed into its fully collapsed state. The binding of the mast sections can occur from a variety of reasons, for example, debris trapped between the telescopic mast sections, high wind loads that create a bending moment in the mast sections, or simply lack of proper maintenance and or lubrication of the mast assembly.

In addition, the prior art masts include an open design winch assembly for raising or lowering the individual mast sections. Particularly in sandy or dry dusty regions, an open design winch assembly is prone to accelerated wear-out. This is due to debris or other aggregate materials accumulating on various internal operating components of the winch assembly, such as the bearings, drums, gears, ratchet assemblies, etc. Moreover, open winch designs create pinch hazards for the operators.

Furthermore, the prior art masts often include a winch assembly that is not easily detached from the mast assembly. In these cases, a fixed or permanent winch increases the transport weight and creates a bulky protrusion that inhibits the portability and efficient storage of the mast assembly.

Further still, the prior art mast assemblies include a fixed input-to-output reduction ratio for driving the winch. In these cases, either valuable time is lost in a system with excessive reduction or increased fatigue is experienced in a system with inadequate speed reduction.

Accordingly, it has been considered desirable to develop a new and improved field mast system which would overcome the foregoing difficulties and others while providing better and more advantageous overall results.

BRIEF DESCRIPTION

According to one aspect of the present invention, a portable telescopic mast assembly with positive retraction for raising and lowering an associated device is provided. The mast assembly includes an outer body and a plurality of mast sections slideably engaged with the outer body. A lifting cable is disposed between the plurality of mast sections. The lifting cable operatively connects the plurality of mast sections so as to urge one or more of the mast sections towards an extended position. The lifting cable includes a first end and a second end, the first end being secured to an inner most mast section of the plurality of mast sections. A retraction cable is disposed at least partially inside the outer body. The retraction cable includes a first end and a second end, the first end being secured to the inner most mast section. A winch is secured to the outer body. The winch includes a first output and a second output, the second end of the lifting cable operatively connected to the first output and the second end of the retraction cable operatively connected to the second output.

According to another aspect of the present invention, an extendable strap driven mast assembly for raising and lowering an associated device is provided. The mast assembly includes an outer hollow body. A plurality of nested mast sections of consecutively smaller transverse dimension are disposed at least partially inside the outer body when the mast sections are in a collapsed state. Each of the mast sections is slideably engaged with respect to the other. A lifting strap is disposed in a serpentine configuration between the plurality of mast sections and operatively connects the plurality of mast sections so as to urge one or more of the mast sections towards an extended state. The lifting strap includes a first end and a second end, the first end being secured to an inner most mast section of the plurality of mast sections. A retracting cable is disposed partially inside the outer body. The cable includes a first end and a second end, the first end being secured to the inner most mast section so as to urge the mast sections into the collapsed state. A winch is secured to the outer body. The winch includes a first spool and a second spool. The second end of the lifting strap is operatively connected to the first spool and the second end of the retraction cable is operatively connected to the second spool. Wherein the first spool is adapted to withdraw the lifting strap and the second spool is adapted to release the retracting cord when the winch is driven in a first direction. And, wherein the first spool is adapted to release the lifting strap and the second spool is adapted to withdraw the retracting cord when the winch is driven in a second direction.

According to yet another aspect of the present invention, a portable telescopic strap driven mast assembly having an outer body with a plurality of mast sections slideably engaged with the outer body is provided. The mast assembly includes a lifting strap disposed between the plurality of mast sections. The lifting strap is operatively connected to the plurality of mast sections so as to urge one or more of the mast sections towards an extended position. The lifting strap includes a first end and a second end, the first end being secured to an inner most mast section of the plurality of mast sections. A retraction cable is disposed at least partially inside the outer body. The retraction cable includes a first end and a second end, the first end being secured to the inner most mast section. A winch is selectively engaged to the outer body. The winch includes a housing and a transmission. The transmission includes an input, a first output and a second output. The transmission selectively couples the input to the first output and the second output. The first output selectively engages the second end of the lifting strap and the second output selectively engages the second end of the retraction cable.

Still other aspects of the invention will become apparent from a reading and understanding of the detailed description of the preferred embodiments hereinbelow.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION

Figure 1:
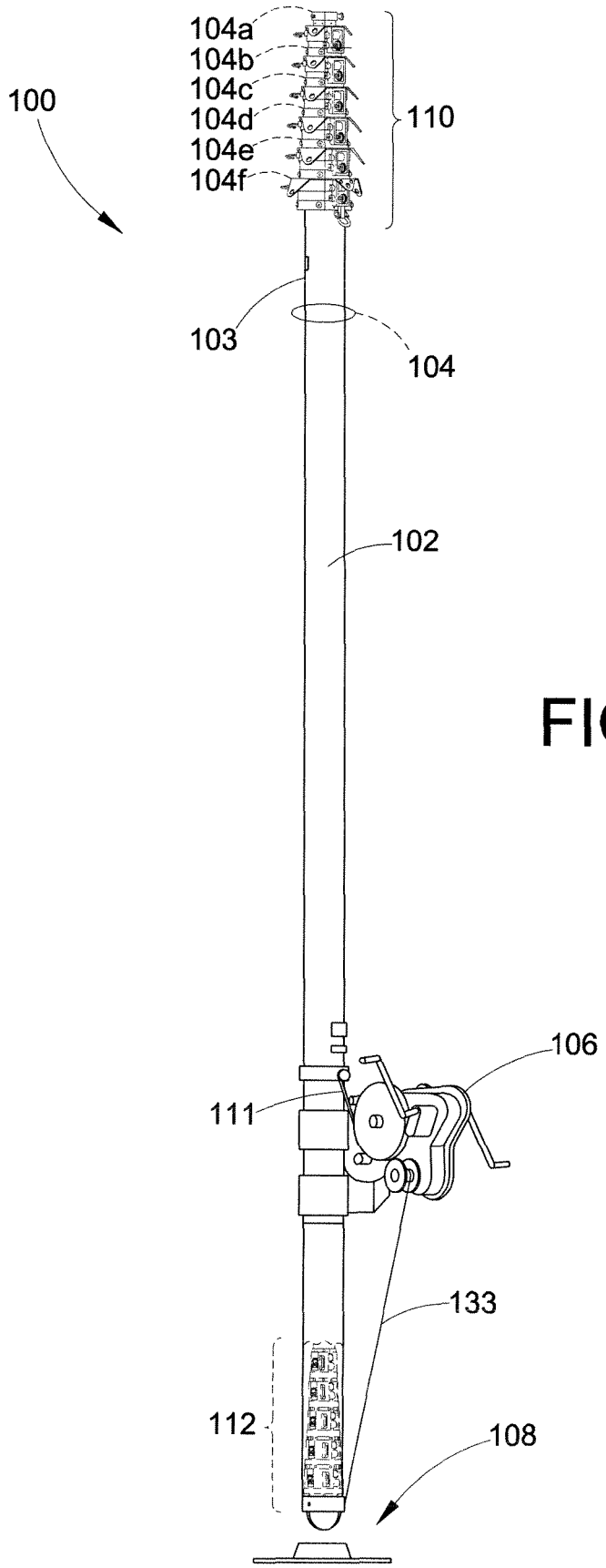
FIG. 1 is a perspective view of a first embodiment of a telescopic strap driven field mast, according to the present invention.

With reference to FIG. 1, a first embodiment of a telescopic field mast 100 is shown. Generally, the field mast 100 includes an outer body 102, a plurality of nested mast sections 104, a winch assembly 106 and a base 108. The plurality of mast sections 104 may include any number of sections necessary to achieve the height required for a given application. In the present embodiment, a field mast 100 is shown having a total of six (6) mast sections 104*a*-104*f* (not including the outer body 102). The first or inner most mast section 104*a* is typically adapted to carry a particular pay load or associated device (e.g., an antenna, a satellite dish, a vision system, a guidance or positioning system, etc).

Figure 1A:
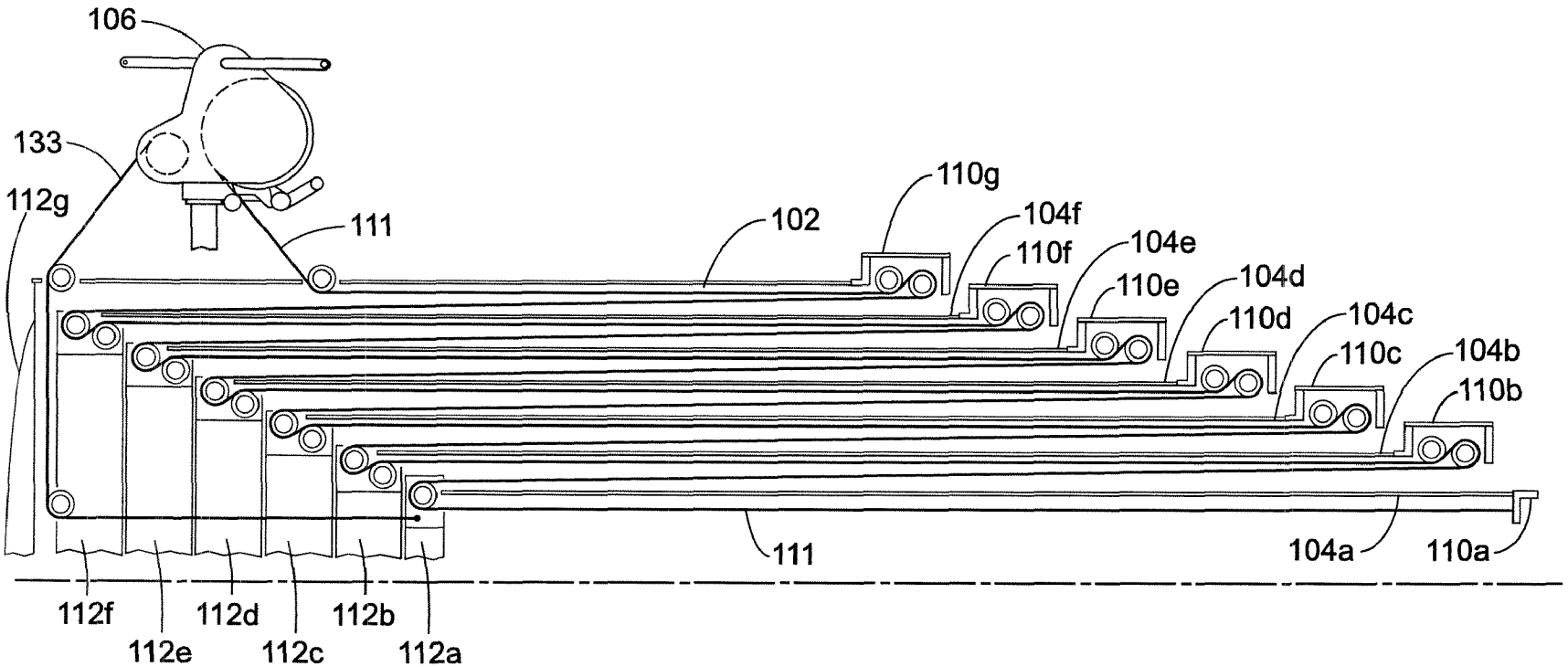
FIG. 1A is a schematic representation of a partial cross sectional view of the field mast of FIG. 1, illustrating the pathway of a lifting strap and a plurality of nested mast sections.

With reference to FIGS. 1 and 1A, the inner most or first mast section 104*a* is nested within the second mast section 104*b*. Similarly, the second mast section 104*b* is nested within the third mast section 104*c* which in turn is nested within the fourth mast section 104*d* and so on. Lastly, the sixth mast section 104*f* is nested within the outer body 102. It should be noted that the mast sections 104 are telescopic in nature with each having a consecutively smaller transverse dimension than the other. In addition, each of the mast sections are slidably engaged with respect to the other such that when each of the individual mast sections 104 is urged into an extended state, the net length of the mast 100 is many times the length of any one of the mast sections 104.

Figure 2:
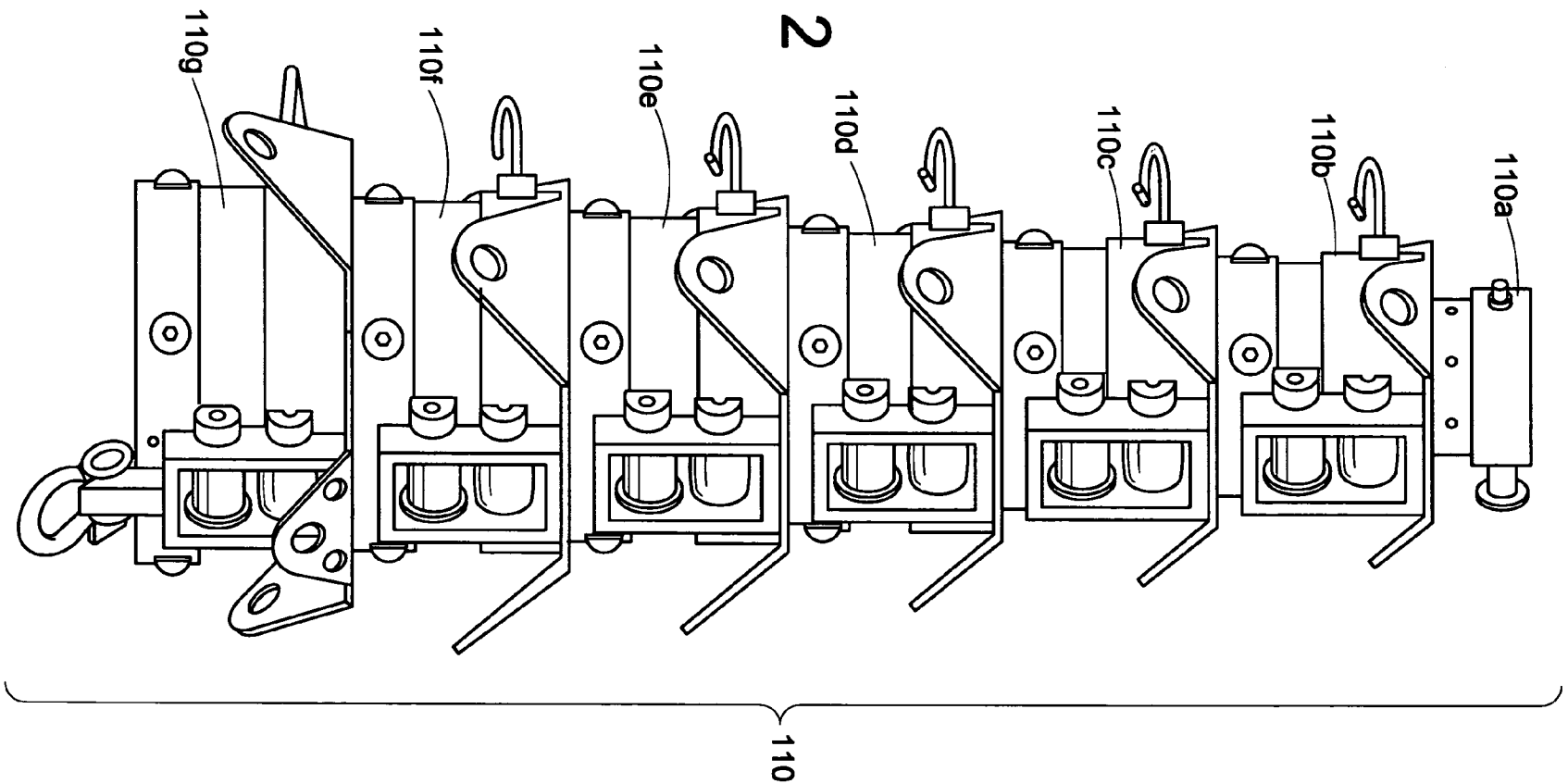
FIG. 2 is an enlarged detail view of a set of upper collar assemblies each for receiving a respective one of a plurality of mast sections of the field mast of FIG. 1.
Figure 4:
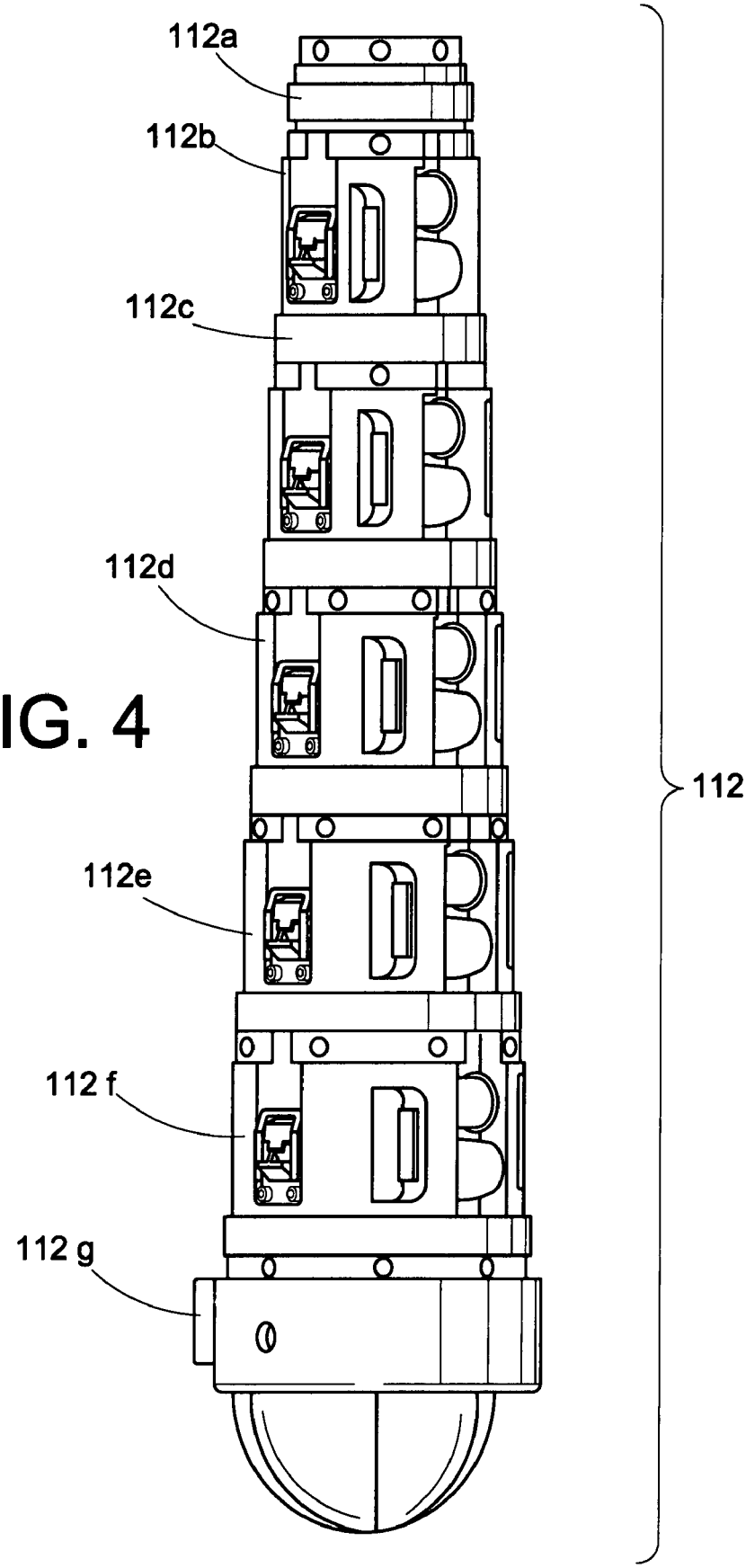
FIG. 4 is an enlarged detail view of a set of lower collar assemblies or base rings each for receiving a respective one of a plurality of mast sections of the field mast of FIG. 1.

With continued reference to FIGS. 1 and 1A, the upper and lower portions of each mast section receives an upper and a lower collar assembly 110, 112. A lifting strap 111 or other cable is sequentially threaded through the respective upper and lower collar assemblies of each of the mast sections in a serpentine fashion. The strap can be substantially flat and fabricated from a high strength low stretch braided nylon or other resilient yet pliable material. Generally, the strap follows a convoluted pathway between and among the mast sections. Beginning from the winch assembly, the strap can pass through the outer body 102, and travel upward to a fixed upper collar assembly 110*g* (FIG. 2). The strap may then travel downward between the outer body 102 and the sixth mast section 104*f* to a lower collar assembly 112*f* (FIG. 4). The strap can then be redirected upward to an upper collar assembly 110*f* (FIG. 2) of the sixth mast section 104*f* and from there return downward to a lower collar assembly 112*e* (FIG. 4) of the fifth mast section 104*e*. The strap can continue this "zig-zag" or serpentine pattern until terminating at the upper portion of the inner most mast section 104*a*. When tension is applied to the portion of the strap external to the outer body 102, the mast sections (104*a*-104*f*) are then urged toward an erect or extended state.

With reference to FIG. 2, an enlarged detailed view of the upper collar assemblies 110 is shown. In particular, the first mast section receives a first upper collar assembly 110*a*, the second mast section receives a second upper collar assembly 110*b*, the third mast section receives a third upper collar assembly 110*c* and the fourth mast section receives a fourth upper collar assembly 110*d*. Similarly, as described previously, the fifth mast section receives the fifth upper collar assembly 110*e*, the sixth mast section receives the sixth upper collar assembly 110*f*, and the outer body section 102 (FIG. 1) receives the stationary or fixed upper collar assembly 110*g*. As shown in FIG. 2, the individual upper collar assemblies 110*a*-110*g* are illustrated in their most compact state, with one being in a stacked configuration with respect to the other. It should be noted that with exception to the first upper collar 110*a*, the remaining upper collar assemblies 110*b*-110*g* are substantially identical in structure varying primarily only in size or diameter.

Figure 3:
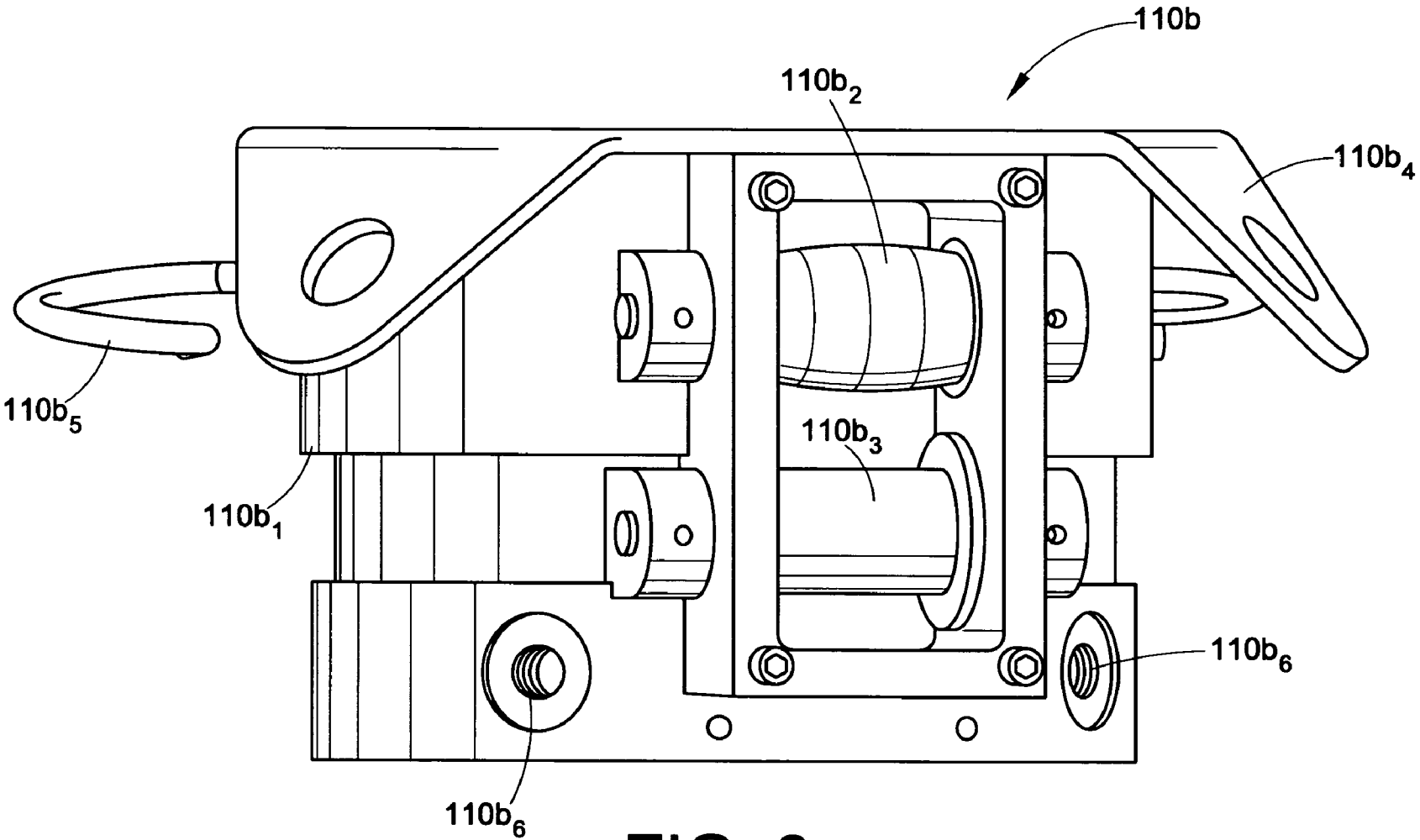
FIG. 3 is an enlarged detail view of one of the upper collar assemblies of FIG. 2.

With reference to FIG. 3, the second upper collar assembly 110*b* is shown in greater detail. Generally, the collar assembly 110*b* includes a collar body $\mathbf{110}b_1$, a primary roller $\mathbf{110}b_2$, a secondary or guide roller $\mathbf{110}b_3$, a support or guy plate $\mathbf{110}b_4$ and one or more device cable guides $\mathbf{110}b_5$. The primary roller $\mathbf{110}b_2$ is generally responsible for redirecting the lifting strap and for carrying the majority of the tension load created in the lifting strap. In addition, a roller surface of each primary roller of each collar assembly may include a convex or curved profile to facilitate the alignment of the strap as it passes over the roller and through the collar body. If the strap is not properly aligned or centered as it passes over the rollers of the collar assemblies, the strap may interfere with the collar bodies leading to fraying and or premature failure of the strap. On the other hand, the secondary or guide roller $\mathbf{110}b_3$ is subject to lower loads and is generally used to offset the lifting strap in a transverse direction so as to prevent the lifting strap from directly contacting the collar body or rubbing against the mast sections. In addition, the second upper collar assemblies may include a bearing surface (not shown) along an inner wall surface of the assemblies for slideably engaging an outer wall surface of each of the respective inner mast sections.

With continued reference to FIG. 3, a lower portion of the collar body 110$b_1$ is configured to be secured to its respective mast section, which in this example is the second mast section 104*b* (FIG. 1). The collar body 110$b_1$ can be secured to the mast section via a plurality of threaded fasteners which engage threaded apertures 110$b_6$ as well as the underlying mast section. Because of the thin wall and/or light construction of the individual mast sections, the tips of the threaded fasteners which engage the threaded apertures 110$b_6$ include smooth or unthreaded shoulders. The shoulders are adapted to engage the walls of the mast section without compressing or contorting the geometry of the mast section. The guide plate 110$b_4$ may be provided for receiving a stabilizing guy wire for stabilizing the mast either during or after the mast erection process. The guide plate 110$b_4$ may be fabricated from a flat piece of material having bent ears or tabs with various apertures for receiving the stabilizing guy wires.

Now with reference to FIG. 4, an enlarged view of the base rings or lower collar assemblies 112 is shown. In particular, the first mast section receives a lower collar assembly 112*a*, the second mast section receives a lower collar assembly 112*b*, the third mast section receives a third lower collar assembly 112*c* and the fourth mast section receives a fourth lower collar assembly 112*d*. Similarly, as described previously, the fifth mast section receives the fifth lower collar assembly 112*e*, the sixth mast section receives the sixth lower collar assembly 112*f* and the outer body receives a first or convex shaped base portion 112*g*. As with the upper collar assemblies described above, each of the mast sections receive a lower collar assembly 112 and the majority of the lower collars are substantially identical in structure varying only in overall size or geometry (with exception of the first lower collar 112*a*). It should be noted the convex shaped base portion 112*g* permits the mast to be received into a base 108 having a recessed or concave portion. The concave/convex design of the base portion of the mast allows the mast to be erected in a desired orientation (e.g. a plumb or vertical orientation) even if the ground or support surface is not orthogonal with respect to the mast.

Figure 5:
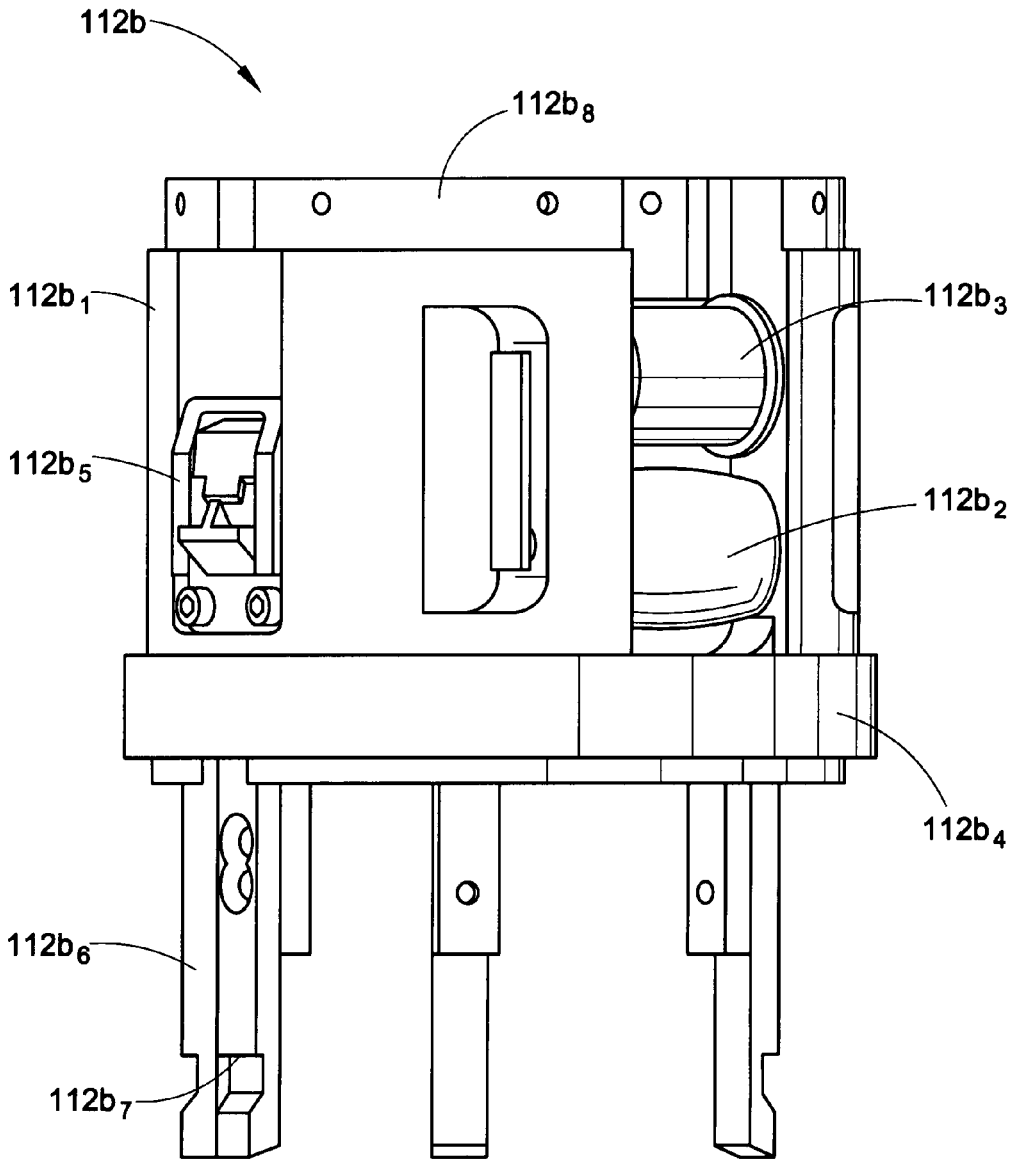
FIG. 5 is an enlarged detail view of one of the lower collar assemblies of FIG. 4 illustrating a mast lock and a plurality of locking post members.

With reference to FIG. 5, the second lower collar assembly 112*b* is shown in greater detail. It should be noted that the second lower collar assembly 112*b* is representative of the remaining lower collar assemblies 112*c*-112*f*. The collar assembly 112*b* includes a collar body 112$b_1$, a primary roller 112$b_2$, and a secondary or guide roller 112$b_3$. It should also be noted that the rollers of the lower collar assemblies are similar in structure and serve a similar purpose as the rollers of the upper collar assemblies. In addition, the second lower collar assembly 112*b* includes a bearing surface 112$b_4$ for slideably engaging an inner wall surface of the overlying mast section. The second lower collar assembly 112*b* further includes one or more locks 112$b_5$ and a plurality of locking posts 112$b_6$ having a supporting surface 112$b_7$. Furthermore, the second mast section 104*b* (FIG. 1) is received onto a flange surface 112$b_8$ of the collar body 112$b_1$ and is attached in a similar manner as discussed with respect to the upper collar assemblies 110 (FIG. 2).

In general, the locks of the lower collar assemblies engage the locking posts of the lower collar assembly just ahead of or above the instant lower collar assembly. By way of example and with respect to the second lower collar assembly 112*b* shown in FIG. 5, the lock 112$b_5$ operates to secure the locking post of the first collar assembly 112*a* (FIG. 4). Similarly, the lock of the third lower collar 112*c* (FIG. 4) engages the locking post 112$b_6$ of the second lower collar assembly 112*b* and so on. An advantage of this design is that it prevents the mast sections from being erected simultaneously or in an out of sequence fashion. In the field, it is generally preferred to raise the largest diameter sections first since they offer greater stiffness and stability while supporting the smaller diameter mast sections ahead of it.

For example, the sixth mast section 104*f* (FIG. 1) is the largest diameter mast section of the instant embodiment. Since the sixth mast section does not lock to the outer body, the sixth mast section will extend out of the outer body carrying with it all of the remaining mast sections as tension is applied to the lifting strap. As the sixth mast section reaches its fully extended state, a lock trip 103 (FIG. 1) near the upper portion of the outer body 102 (FIG. 1) causes the lock of the sixth lower collar assembly 112*f* (FIG. 4) to be disengaged thus releasing the locking posts of the fifth lower collar assembly 112*e*. With the locking posts of the fifth lower collar assembly 112*e* (FIG. 4) released, the fifth mast section can then be raised or extended into place. At this point the winching process may be temporarily halted so that the support or guide plate of the sixth collar assembly 110*f* (FIG. 2) can be secured. This process of unlocking and stabilizing can then be repeated with respect to the fifth, fourth, third, second and first mast sections or until an adequate amount of extension or elevation is obtained.

Figure 6:
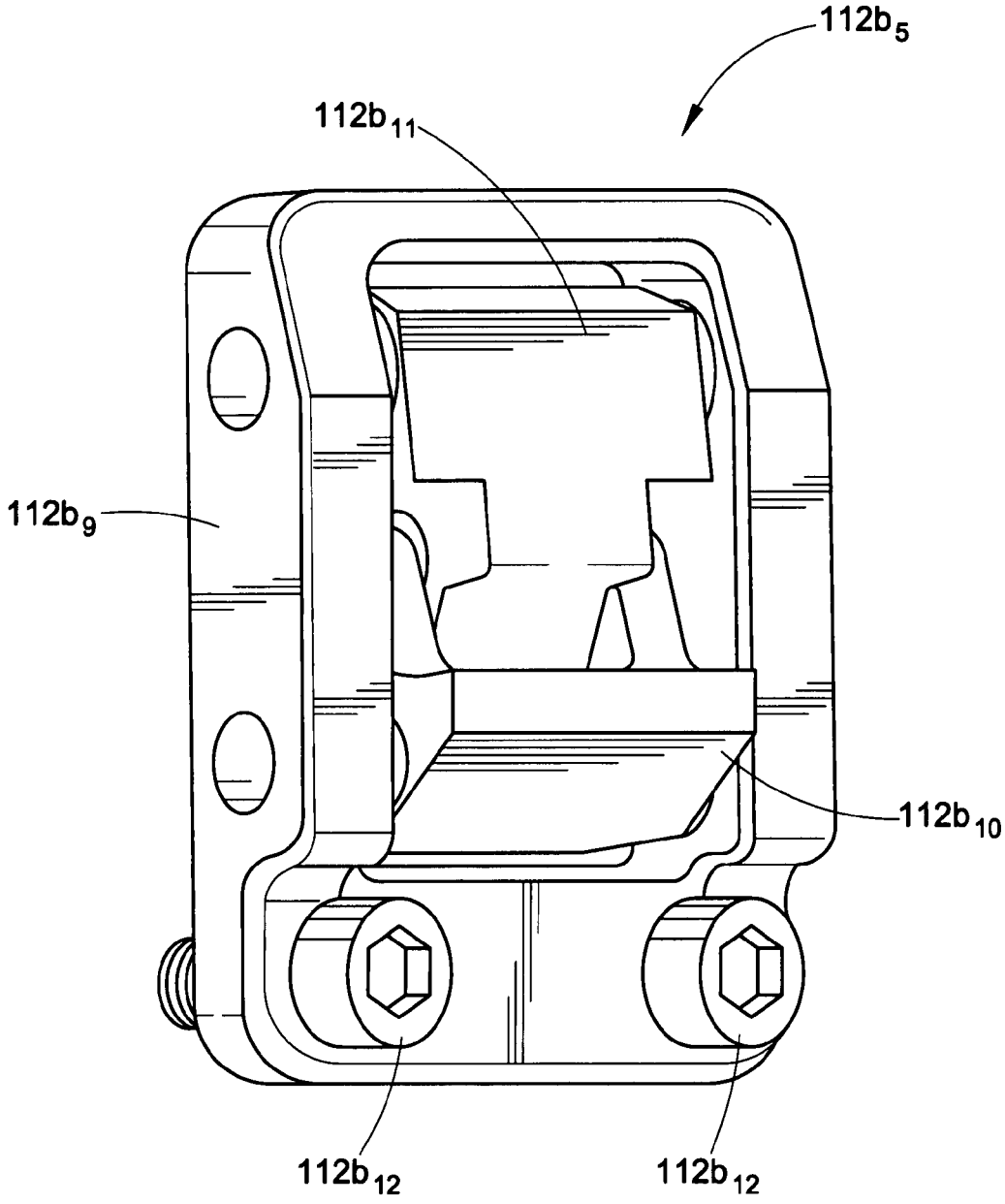
FIG. 6 is an enlarged detail view of the mast lock of FIG. 5.

Now with reference to FIG. 6, an enlarged detail of the lock of the second collar assembly 112*b* is shown. It should be noted that the lock 122$b_5$ is representative of the remaining locks on the remaining lower collar assemblies 112*c*-122*f* (FIG. 4). The lock assembly 112$b_5$ includes a lock housing 112$b_9$ for pivotally securing a rocker 112$b_{10}$, as well as a locking member 112$b_{11}$. The rocker 112$b_{10}$ and the locking member 112$b_{11}$ operate in an over-center type configuration such that the locking member 112$b_{11}$ is securely in a latched or unlatched state depending on the relatively sensitive movement of the rocker 112$b_{10}$. Furthermore, a set of threaded fasteners 112$b_{12}$ may be used to secure the lock housing 112$b_9$ to the respective lower collar assembly 112 or, as in this case, to the second lower collar assembly 112*b* (FIG. 5). In addition, multiple lock assemblies may be disposed about the circumference of the lower collar bodies to better balance the loads on the locks and the individual mast sections.

Figure 7:
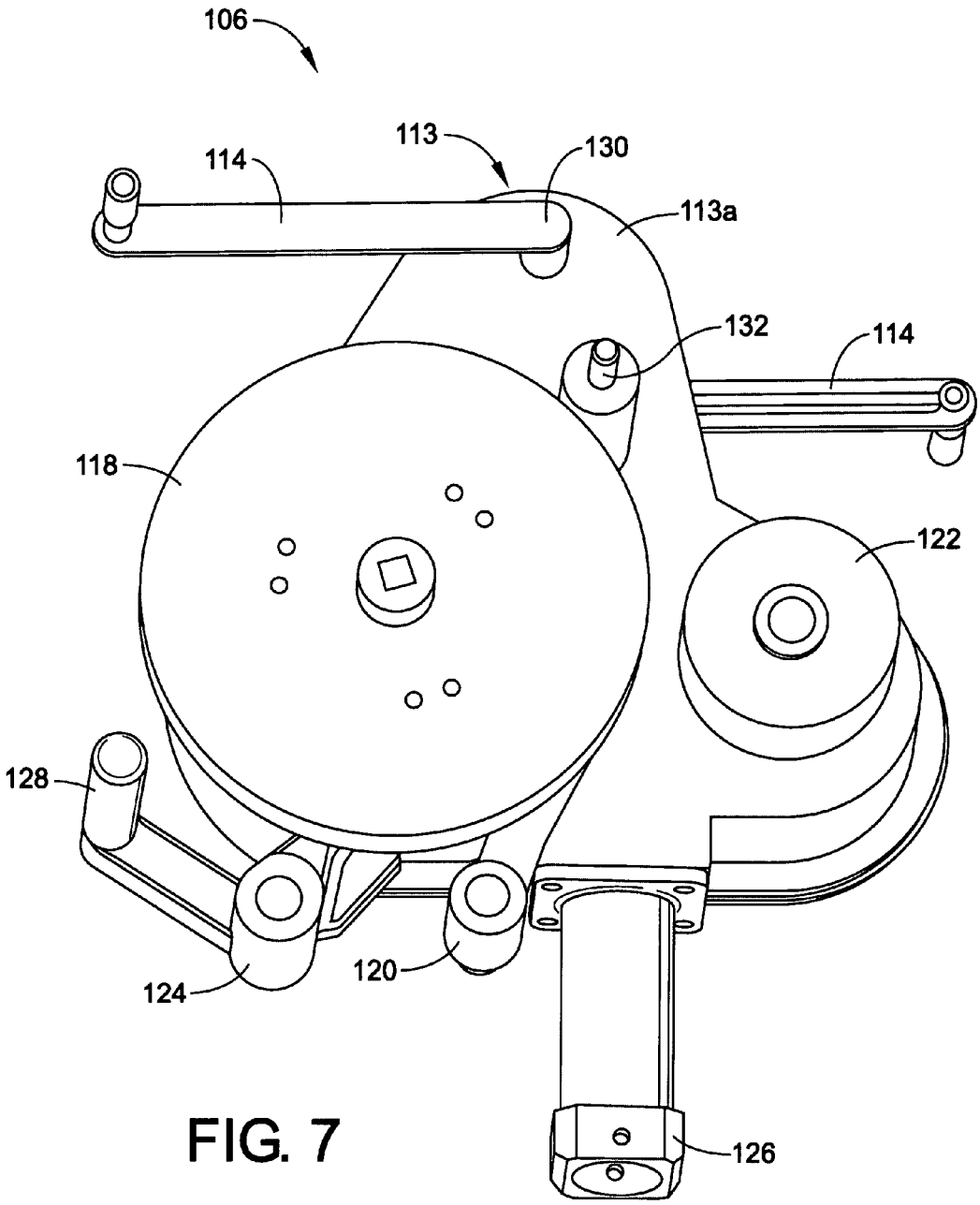
FIG. 7 is a perspective view of a first side of a winch assembly of the field mast of FIG. 1 illustrating a sealed transmission housing, a lifting strap drum, and a retraction cable drum.
Figure 9:
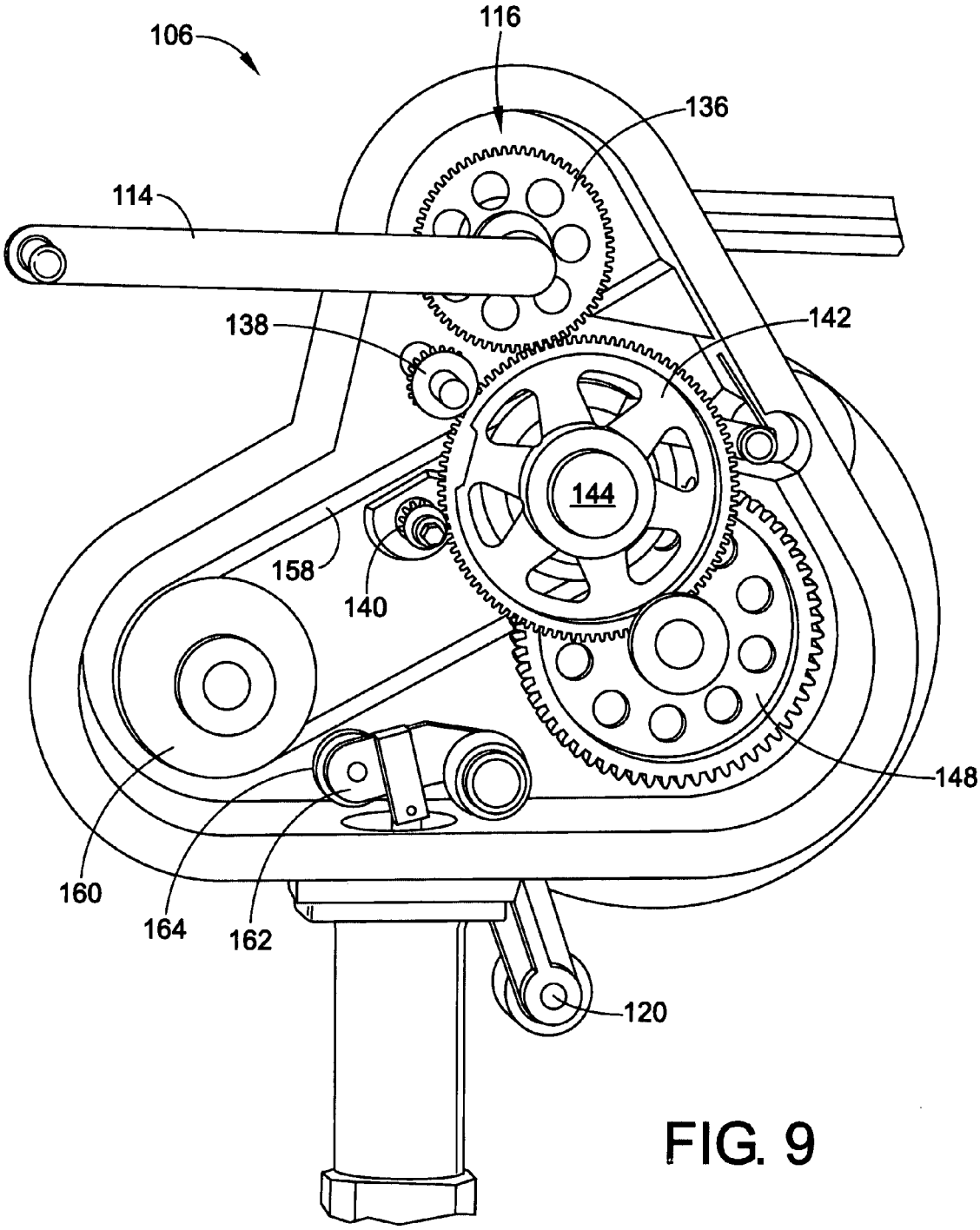
FIG. 9 is a perspective view of a transmission of the winch assembly of FIG. 7.

With reference to FIG. 7, the winch assembly 106 is shown in greater detail. The winch assembly 106 generally includes a transmission or winch assembly housing 113, and a set of winch or crank handles 114 for driving a transmission 116 (FIG. 9). The winch assembly further includes a first or main winch drum or spool 118, a tensioning assembly 120, and a second or positive retraction drum or spool 122. A first attachment point or mounting sleeve 124 and a second attachment point 126 are also provided for quickly and selectively mounting the winch assembly 106 to the outer body 102 (FIG. 1). In addition, a carrying handle 128 can be integrated as part of the winch assembly 106 for ease of handling when the winch assembly 106 is detached from the outer body.

As shown in FIG. 7, the transmission 116 of the winch assembly 106 includes a first or high speed input 130 as well as a second or low speed input 132. The crank handles 114 may be relocated from the first input 130 to the second input 132 as needed, depending on the overall weight of the mast to be lifted and/or the associated payload or device to be carried by the mast. As the crank handles 114 are rotated, the transmission 116 provides a geared mechanical advantage to the main drum or lifting spool 118 such that the lifting strap is drawn towards the drum or spool 118 against the tensioning assembly 120 and wrapped or rolled onto the drum or spool 118. Simultaneously, when the drum or spool 118 is taking-up or gathering the lifting strap, the retraction drum or spool 122 is rotating in a direction that releases or feeds out a retraction cord or cable 133 (FIGS. 1 and 1A). The retraction cord or cable includes a first and second end. The first end of the retraction cord can be attached to the inner most mast section and the second end can engage the retraction drum 122.

Thus, as the lifting strap is drawn towards or into the main drum 118, the mast sections begin to move in an upward or outward direction, the retraction drum 122 unwinds, and the retraction cable is drawn into the outer body.

Figure 8:
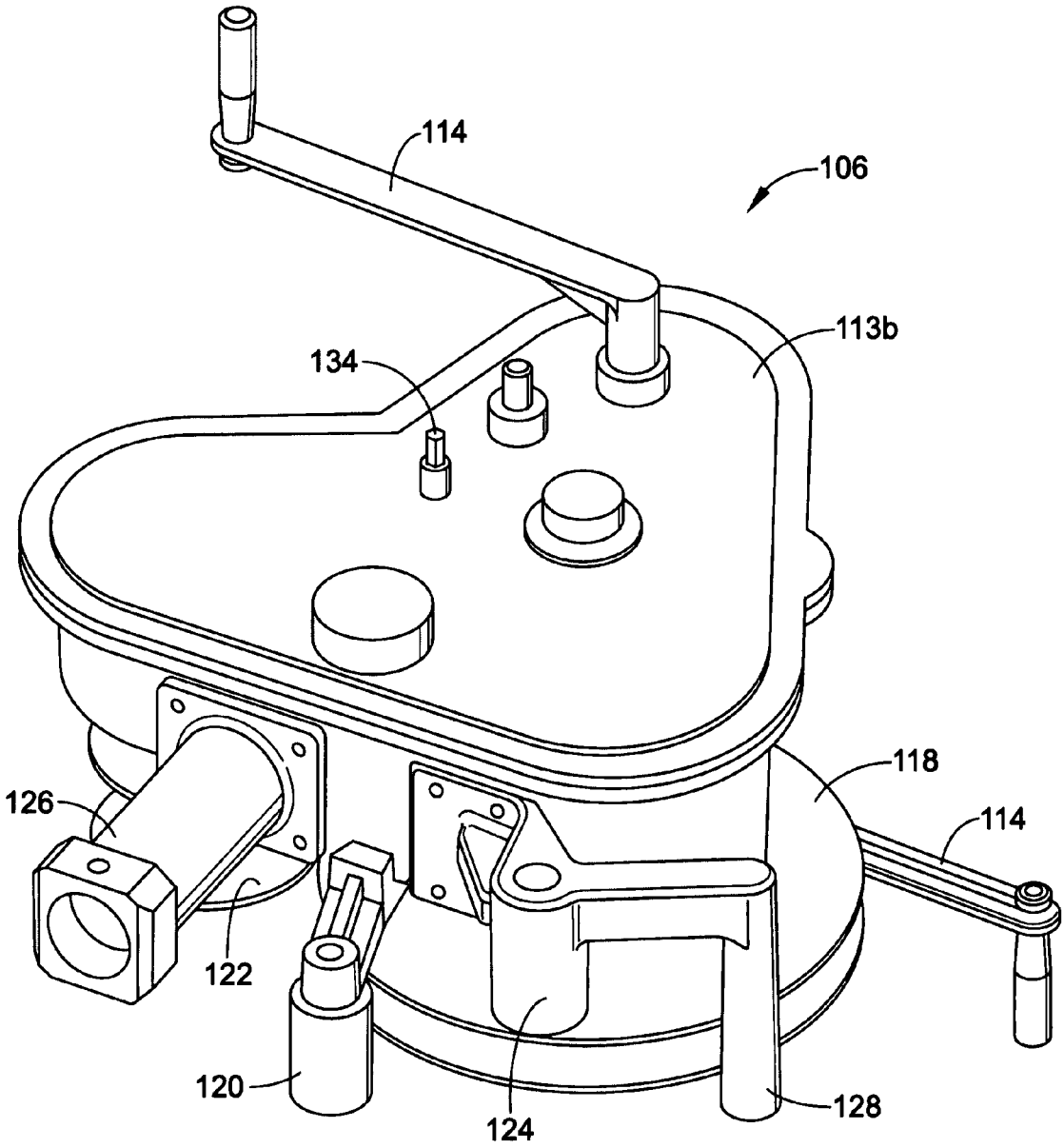
FIG. 8 is a perspective view of a second side of the winch assembly of FIG. 7, illustrating a carrying handle and an auxiliary input.

Now with reference to FIG. 8, a second side of the winch assembly 106 is shown. The gear or transmission housing 113 can be comprised of two halves, a first half 113*a* and a second half 113*b*. Furthermore, the gearing assembly or transmission 116 can be fully enclosed, and thus sealed from dirt, debris, liquids, or other foreign matter, etc. that could damage the gear train, bearings, and/or other elements of the transmission. It should be noted that, in addition to the first and second inputs of the transmission described previously, the transmission 116 may include a third input 134 for use with an external or auxiliary torque source. For example, a chuck portion of a cordless drill may be adapted to engage and drive the input 134. In addition, the input 134 may include a hexagonal or other irregular surface feature so as to ensure positive contact or drive between the auxiliary torque source and the input 134.

Figure 10:
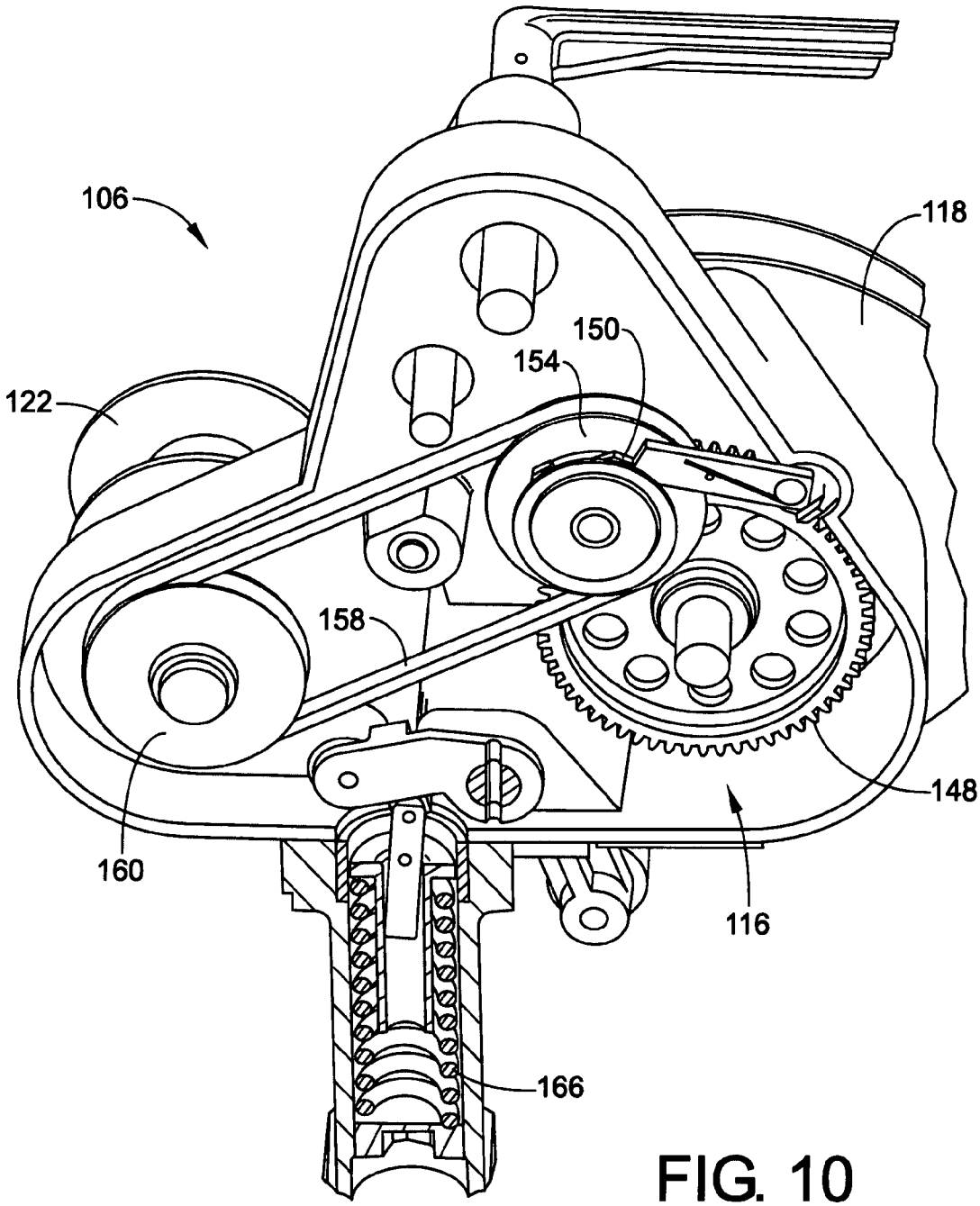
FIG. 10 is a perspective view of the transmission of the winch assembly, partially broken away, illustrating a ratchet assembly and a retraction cable belt drive.
Figure 11:
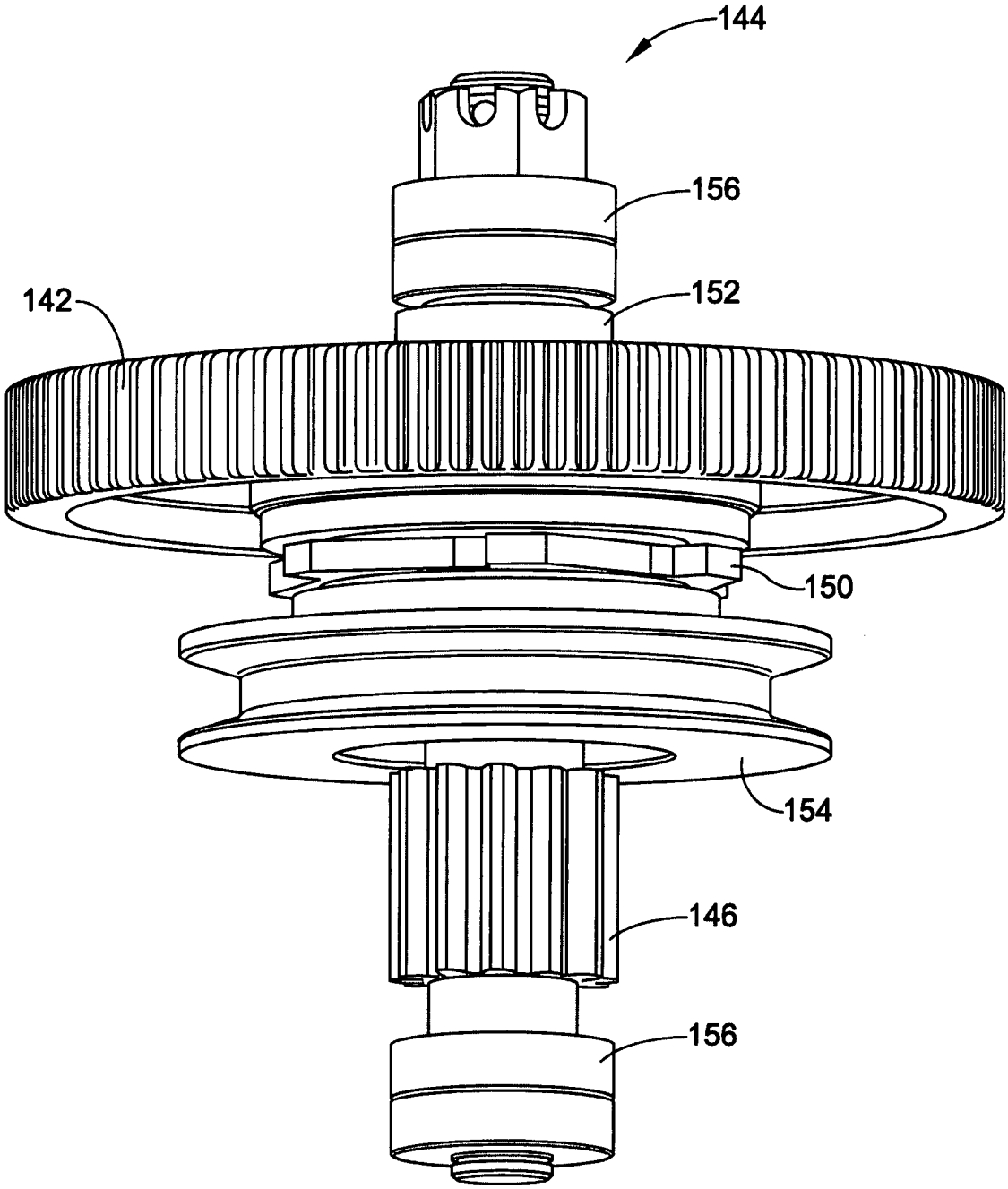
FIG. 11 is a perspective view of an intermediate drive shaft of the transmission of FIG. 7 illustrating a one-way clutch and a ratcheting hub.

Now with reference to FIG. 9-11, the transmission 116 of the winch assembly 106 is shown in greater detail. Generally, the transmission 116 includes a first driving gear 136 associated with the first speed or input 130 (FIG. 7), a second driving gear 138 associated with the second speed or input 132 (FIG. 7) and a third driving gear 140 associated with the third speed or auxiliary torque source 134 (FIG. 8). The first, second, and third driving gear 136, 138, 140 can rotate a first driven gear 142 that in turn rotates an intermediate drive shaft 144.

With particular reference to FIG. 11, when the first driven gear 142 rotates in the lifting direction, the intermediate drive shaft 144 rotates, which in turn rotates a fourth driving gear 146. The fourth driving gear 146 then rotates the primary or main output gear 148 and the main drum or spool 118 (FIG. 10). In addition, the intermediate drive shaft 144 includes a ratcheting hub 150 that prevents the fourth driving gear 146, the main output gear 148, and the main drum or spool from unwinding during the lifting or winching process. It should be noted that a plurality of bearings 156 serve to support the shaft 144 with the transmission and housing of the winch assembly.

With reference to FIGS. 10 and 11, when the first driven gear 142 rotates in the retraction direction, a one way clutch 152 selectively disengages the first driven gear 142 from the ratcheting hub 150 while continuing to allow the first driven gear 142 to rotate a driving retraction pulley 154. The driving pulley 154 then drives a retraction drive belt 158. Whether the drive belt 158 can rotate a driven retraction pulley 160 and corresponding retraction drum 122 depends on the coupling/decoupling position of the tensioning assembly 120. The tensioning assembly 120 includes a reaction arm 162 having an idler roller 164 for tensioning and de-tensioning the belt drive 158 according to the amount of tension in the strap or lifting belt.

When the lifting belt has a significant amount of stress applied to it, the tensioning assembly 120 reacts against the force of an embedded spring 166 such that the driven pulley 160 is decoupled from the input side of the transmission 116. As such, the retraction cord is permitted to unwind at a rate that is commensurate with the overall distance traveled by the mast sections. When no tension is present on the lifting strap, the spring 166 reacts against the reaction arm 162 to provide tension against the drive belt 158 so as to couple or provide relative positive traction between the driving pulley 154 and the driven pulley 160. Thus, a user can retract the mast sections by driving the crank handles in reverse, de-tensioning the lifting strap, coupling the retraction belt to the retraction drum, and withdrawing the retraction cord or cable from the outer body of the mast.

Figure 12:
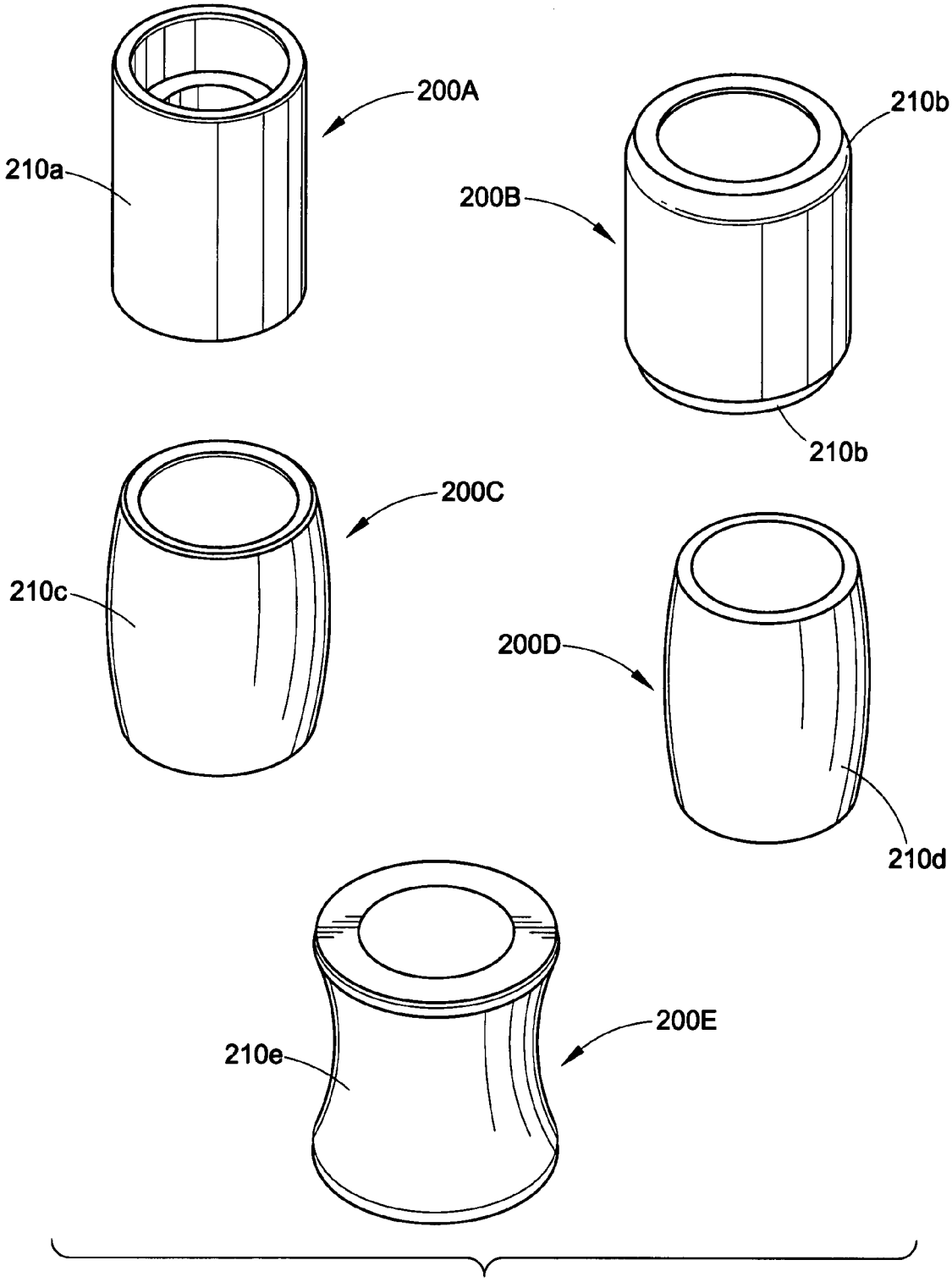
FIG. 12 is an illustrative view of various embodiments of a non-flanged strap roller capable of being used in a strap driven mast, according to the present invention.
Figure 13:
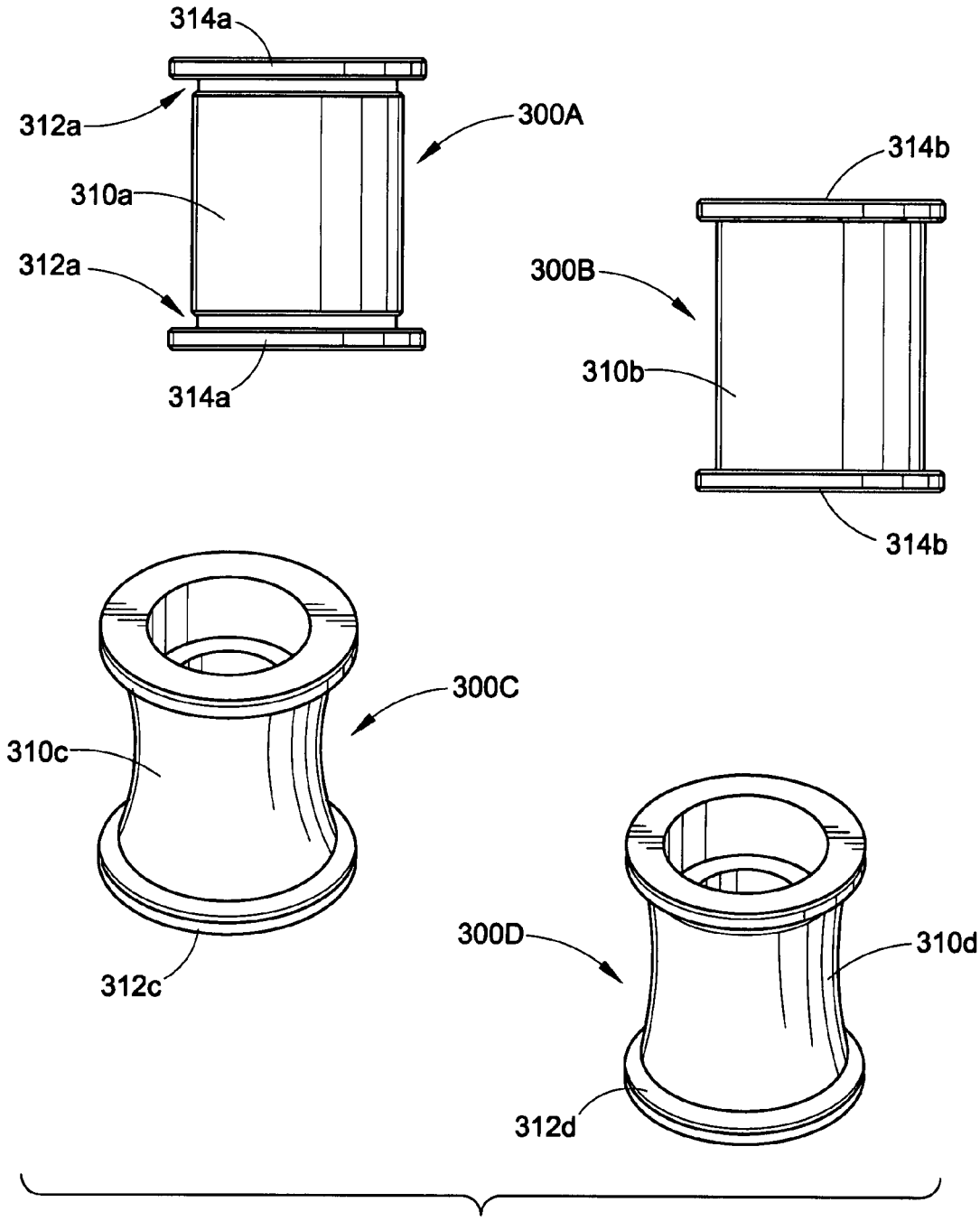
FIG. 13 is an illustrative view of various embodiments of a flanged strap roller capable of being used in a strap driven mast, according to the present invention.

With reference to FIGS. 12 and 13, a variety of roller geometries are illustrated for use with the strap driven mast of the present invention. In particular, FIG. 12 illustrates a variety of flangeless roller geometries. A first embodiment of a flangeless roller 200A includes a generally cylindrical surface geometry 210*a*. A second embodiment of a flangeless roller 200B includes a surface geometry similar to that of the first roller 200A, except that the ends include a chamfer 210*b*. A third and fourth embodiment of a flangeless roller 200C, 200D includes a generally convex surface geometry 210*c*, 210*d*. By contrast, a fifth embodiment of a flangeless roller 200E includes a generally concave surface geometry 210*e*.

With reference to FIG. 13, a variety of flanged roller geometries are illustrated. A first embodiment of a flanged roller 300A is shown having a generally cylindrical surface 310*a* as well as an undercut 312*a* near the ends of the roller and adjacent to a flanged portion 314*a*. A second embodiment of a flanged roller 300B is shown that is similar to the first embodiment of the flanged roller 300A in that it includes a generally cylindrical surface 310*b* as well as a pair of flanged end portions 314*b*, however, no undercut is provided. Lastly, a third and a fourth embodiment of a flanged roller 300C, 300D is illustrated having a generally concave surface geometry 310*c*, 310*d* and a transition region or fillet 312*c*, 312*d* between the strap engaging surface and the flange.

The various embodiments of roller geometries 200A-200E, 300A-300D may be used in various combinations to optimize the self-centering characteristics of the rollers while minimizing any interference between the lifting strap or cable and the structures of the mast assembly surrounding the strap or cable. Furthermore, depending on the elastic properties of the strap or cable and the overall stress or loads expected to be carried by the strap certain ones of the above disclosed geometries may be more suitable than the others for a given application. In addition, the curvilinear profile or geometry of the roller surface can be modified so as to optimally and evenly distribute the stress through a cross section of the strap, thus, maximizing the longevity of the lifting strap.

Generally, the convex roller geometry provides for optimum tracking and compensates for production variations (such as twist or other misalignment in the tubes or mast sections). On the other hand, the concave roller geometry can be useful in guiding the strap into and out of the tubes or mast sections while allowing the concave rollers to be mounted in close proximity to the tubes. This can occur since the "concavity" of the concave rollers can be matched to the outer diameter of the tubes. Finally, the straight roller geometry generally provides the most uniform loading across the strap and serves as a good intermediate geometry next to a concave or convex roller. The lips, undercuts, and chamfers on the edges of the rollers further aid in tracking the strap on the roller by interrupting the surface onto which the strap would otherwise begin to track off center. In other words, the strap is most likely to travel off center on a uniform (straight), continuous surface. As such, these features provide an interruption to prevent the strap from moving too far off center or to one side of the respective roller.

Lastly, the strap driven mast assembly of present invention can be operated or used in any number of ways. In general, the associated device to be elevated can be attached (if not already secured to the mast assembly) to the inner most or first mast section 104*a*. The base 108 (FIG. 1) of the mast system is then secured to the ground or other associated support surface where the mast is to be erected. Once the base is installed, the convex end portion 112*g* of outer body 102 is then located in the recess portion of the base 108. The outer body 102 is then raised and temporarily held in the desired orientation. Typically a vertical or plumb orientation is chosen since side loading of the mast sections is minimized. At this point, the outer body is stabilized by attaching three or more guy wires to the support or guide plate of the fixed upper collar assembly 110*g* (FIG. 2). Next, the winch assembly 106 can be attached to the outer body via the first and second attachment points 124, 126 (FIG. 7).

Once the winch assembly is attached, the ends of the lifting strap and retraction cable are attached to the lifting drum and to the retraction drum, respectively. The crank handles may then be attached to the first or second speed inputs on the winch assembly. Alternately, an external or auxiliary torque device (e.g. an electric motor) may be attached to the third or auxiliary input. Rotating the first, second, or third inputs in the lifting direction, causes the main or lifting drum to wind or withdraw the lifting strap. As tension is created, the sixth mast section 104*f* will rise carrying with it the remaining mast sections 104*a*-104*e*. In the meantime, the retraction drum remains decoupled so long as there is some degree of tension in the lifting strap. As such, the retraction cable is released or drawn into the outer body as the mast sections are raised. Once the sixth mast section is raised to its maximum height or fully extended position, trip 103 causes the lock assembly of the sixth lower collar assembly 112*f* (FIG. 4) to disengage and release the fifth mast section 112*e*. The process of raising, releasing, and stabilizing mast sections continues in a similar manner for the remaining mast sections or until the desired height is reached.

When the mast is to be lowered, the crank handles are simply operated in an opposite or retraction direction. As described previously, this causes a lesser amount of tension on the lifting strap and a coupling of the retraction drum 122. If the mast sections begin to bind slightly, the retraction drum begins to pull on the retraction cable or cord, urging the inner most mast section (as well as the remaining mast sections) into a collapsed state. As the mast sections are lowered, the stabilizing guy wires, if any, are removed. Once all of the mast sections have reached their fully retracted or collapsed state, the associated payload or device, the winch assembly, and the initial stabilizing guy wires can all be removed. The mast is then lowered to the ground, the base detached from the associated support surface, and the mast is prepped for transportation.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A portable telescopic mast assembly with positive retraction for raising and lowering an associated device, the mast assembly comprising:

an outer body;

a plurality of mast sections slideably engaged with the outer body;

a lifting cable disposed between the plurality of mast sections, the lifting cable operatively connecting the plurality of mast sections so as to urge one or more of the mast sections towards an extended position, the lifting cable having a first end and a second end, the first end being secured to an inner most mast section of the plurality of mast sections;

a retraction cable disposed at least partially inside the outer body, the retraction cable having a first end and a second end, the first end being secured to the inner most mast section;

a winch secured to the outer body, the winch including a first output and a second output, the second end of the lifting cable operatively connected to the first output and the second end of the retraction cable operatively connected to the second output; and wherein at least one of the plurality of mast sections further includes an upper collar assembly and a lower collar assembly for operatively engaging the lifting cable.

2. The mast assembly of claim 1, wherein each of the plurality of mast sections further include a locking assembly and a trip for locking and unlocking another of the plurality of mast sections or the outer body, the locking assemblies cooperating with the respective trips to allow the extension and retraction of only one of the plurality of mast sections at a time.

3. The mast assembly of claim 1, wherein at least one of the plurality of mast sections further includes a support plate for attaching an associated support cable.

4. The mast assembly of claim 1, wherein the winch further includes a substantially sealed transmission housing.

5. The mast assembly of claim 1, wherein the winch is selectively engageable with the outer body, the lifting cable, and the retraction cable.

6. The mast assembly of claim 1, further comprising a base including a recessed portion for receiving a convex end of the outer body.

7. An extendable strap driven mast assembly for raising and lowering an associated device, the mast assembly comprising:

an outer hollow body;

a plurality of nested mast sections disposed at least partially inside the outer body when the mast sections are in a collapsed state, each of the mast sections being slideably engaged with respect to the other;

a substantially flat lifting strap disposed between the plurality of mast sections and operatively connecting the plurality of mast sections so as to urge one or more of the mast sections towards an extended state, the lifting strap having a first end and a second end, the first end being secured to an inner most mast section of the plurality of mast sections;

a retracting cable disposed partially inside the outer body, the cable having a first end and a second end, the first end being secured to the inner most mast section so as to urge the mast sections into the collapsed state; and a winch secured to the outer body, the winch including a first spool and a second spool, the second end of the lifting strap operatively connected to the first spool and the second end of the retracting cable operatively connected to the second spool;

wherein the first spool is adapted to withdraw the lifting strap and the second spool is adapted to release the retracting cable when the winch is driven in a first direction and wherein the first spool is adapted to release the lifting strap and the second spool is adapted to withdraw the retracting cable when the winch is driven in a second direction.

8. The strap mast assembly of claim 7, wherein the lifting strap includes a flat surface geometry and a generally rectangular cross-section.

9. The strap mast assembly of claim 7, wherein at least one of the plurality of mast sections further includes an upper collar assembly and a lower collar assembly for operatively engaging the lifting strap.

10. The strap mast assembly of claim 9, wherein at least one of the upper collar assembly and the lower collar assembly includes a roller having a curvilinear surface geometry for centering the lifting strap.

11. The strap mast assembly of claim 7, wherein each of the plurality of mast sections further include a locking assembly and a trip for locking and unlocking another of the plurality of mast sections or the outer body, the locking assemblies cooperating with the respective trips to allow the extension and retraction of only one of the plurality of mast sections at a time.

12. The strap mast assembly of claim 7, wherein at least one of the plurality of mast sections further includes a guide plate for attaching an associated guy cable.

13. The strap mast assembly of claim 7, wherein the winch further includes a transmission and a substantially air-tight transmission housing.

14. The strap mast assembly of claim 13, wherein the transmission includes a first input and a second input, the first input having a lower gear ratio than the second input.

15. The strap mast assembly of claim 14, wherein the winch transmission includes a third input adapted to be driven by an auxiliary torque source.

16. The strap mast assembly of claim 7, wherein the winch is selectively engageable with the outer body, lifting strap, and retracting cable.

17. The strap mast assembly of claim 7, further comprising a base including a recessed portion for receiving a convex end of the outer body.

18. A portable telescopic strap driven mast assembly having an outer body with a plurality of mast sections slideably engaged with the outer body, the mast assembly comprising:

a lifting strap disposed between the plurality of mast sections, the lifting strap operatively connecting the plurality of mast sections so as to urge one or more of the mast sections towards an extended position, the lifting strap having a first end and a second end, the first end being secured to an inner most mast section of the plurality of mast sections;

a retraction cable disposed at least partially inside the outer body, the retraction cable having a first end and a second end, the first end being secured to the inner most mast section; and a winch selectively engaged to the outer body, the winch including a housing and a transmission, the transmission including an input, a first output and a second output, the transmission selectively coupling the input to the first output and the second output, the first output selectively engaged with the second end of the lifting strap and the second output selectively engaged with the second end of the retraction cable.

19. The mast assembly of claim 18, wherein the winch housing is substantially sealed.

20. The mast assembly of claim 18, wherein the transmission includes a first input and a second input, the first input having a lower gear ratio than the second input.

21. The mast assembly of claim 18, wherein the transmission includes a third input adapted to be driven by an auxiliary torque source.

22. A portable telescopic mast assembly with positive retraction for raising and lowering an associated device, the mast assembly comprising:

an outer body;

a plurality of mast sections slideably engaged with the outer body;

a lifting cable disposed between the plurality of mast sections, the lifting cable operatively connecting the plurality of mast sections so as to urge one or more of the mast sections towards an extended position, the lifting cable having a first end and a second end, the first end being secured to an inner most mast section of the plurality of mast sections;

a retraction cable disposed at least partially inside the outer body, the retraction cable having a first end and a second end, the first end being secured to the inner most mast section;

a winch secured to the outer body, the winch including a first output and a second output, the second end of the lifting cable operatively connected to the first output and the second end of the retraction cable operatively connected to the second output; and a base including a recessed portion for receiving a convex end of the outer body.

23. A portable telescopic mast assembly with positive retraction for raising and lowering an associated device, the mast assembly comprising:

an outer body;

a plurality of mast sections slideably engaged with the outer body;

a lifting cable disposed between the plurality of mast sections, the lifting cable operatively connecting the plurality of mast sections so as to urge one or more of the mast sections towards an extended position, the lifting cable having a first end and a second end, the first end being secured to an inner most mast section of the plurality of mast sections;

a retraction cable disposed at least partially inside the outer body, the retraction cable having a first end and a second end, the first end being secured to the inner most mast section;

a winch secured to the outer body, the winch including a first output and a second output, the second end of the lifting cable operatively connected to the first output and the second end of the retraction cable operatively connected to the second output; and wherein at least one of the plurality of mast sections further includes a support plate for attaching an associated support cable.

* * * * *